US007190804B2

(12) United States Patent
Nakamura et al.

(10) Patent No.: US 7,190,804 B2
(45) Date of Patent: Mar. 13, 2007

(54) SPEAKER APPARATUS

(75) Inventors: Tohru Nakamura, Tokorozawa (JP); Tomohiro Suenaga, Tokorozawa (JP)

(73) Assignee: Pioneer Corporation, Tokyo-to (JP)

( * ) Notice: Subject to any disclaimer, the term of this patent is extended or adjusted under 35 U.S.C. 154(b) by 535 days.

(21) Appl. No.: 10/718,646

(22) Filed: Nov. 24, 2003

(65) Prior Publication Data

US 2004/0264731 A1 Dec. 30, 2004

(30) Foreign Application Priority Data

Jun. 27, 2003 (JP) ..... 2003-185125

(51) Int. Cl.
*H04R 25/00* (2006.01)

(52) U.S. Cl. ..... 381/423; 381/386; 381/403; 381/423; 381/432

(58) Field of Classification Search ..... 381/386, 381/400, 403, 423, 424, 432; 181/157, 164, 181/165, 171, 172, 173
See application file for complete search history.

(56) References Cited

U.S. PATENT DOCUMENTS 4,146,756 A * 3/1979 Kito et al. ..... 381/426

* cited by examiner

*Primary Examiner*—Curtis Kuntz
*Assistant Examiner*—Tuan Duc Nguyen
(74) *Attorney, Agent, or Firm*—Young & Thompson

(57) ABSTRACT

This invention provides a speaker apparatus that outputs sound having smooth frequency characteristics. To solve the inconvenience with the prior art, this invention is a speaker apparatus comprising a diaphragm and a cylindrical-shaped coil bobbin, and not comprising a center cap that covers the coil bobbin, and where the diaphragm is located such that it rests on the coil bobbin, and the coil bobbin and diaphragm are located such that sound from the coil bobbin and diaphragm is not reflected.

4 Claims, 6 Drawing Sheets

SPEAKER APPARATUS

BACKGROUND OF THE INVENTION

1. Field of the Invention

This invention relates to the construction of a speaker apparatus.

2. Description of the Related Art

In a conventional coaxial speaker, the diaphragm is attached to a coil bobbin with adhesive.

When attaching the diaphragm to the voice coil in this way, the method of locating the inner edge of the diaphragm around the outside of the coil bobbin and attaching the diaphragm and the voice coil is well known.

However, in this kind of conventional method, the inner edge of the diaphragm is attached around the outside of the coil bobbin with adhesive, so high-pitched sounds from the high-pitch diaphragm (not shown in the figures) inside the coil bobbin and sounds from the diaphragm mentioned above are reflected by the edge section around the protruding coil bobbin and thus it is not possible to output sound having smooth frequency characteristics.

In other words, as shown in FIG. 1, in a conventional speaker apparatus, a cone-type diaphragm 3 is attached to the outside of the voice coil, which is the outer edge section 8B around the coil bobbin 8, with adhesive, so in the case of a coaxial speaker, high-pitched sounds from the high-pitch diaphragm (not shown in the figures) inside the coil bobbin 8 are reflected on the inside of the edge section 8B of the protruding coil bobbin 8, or even when the speaker is not a coaxial speaker, sounds generated from the cone-type diaphragm 3 are reflected by the outside of the edge section 8B of the coil bobbin 8, and when sound is reflected by the protruding coil bobbin 8, there is a inconvenience in that it is not possible to output sound having smooth frequency characteristics.

SUMMARY OF THE INVENTION

Therefore, in order to solve the aforementioned inconvenience, the object of this invention is to provide construction of a speaker apparatus that is capable of obtaining optimum frequency characteristics.

(1) The above object of the present invention can be achieved by a speaker apparatus provided with: a diaphragm and coil bobbin formed in cylindrical-shape, and not comprising a center cap that covers the end section of the coil bobbin; and where the diaphragm is located such that it is on the end section of the coil bobbin, and the coil bobbin and diaphragm are both located such that sound generated by the coil bobbin is not reflected.

According to the present invention, high-pitched sound from the high-pitch diaphragm inside the coil bobbin is output without being reflected by the inside of the edge section of the coil bobbin, so it possible to output sound having smooth frequency characteristics.

(2) In one aspect of the present invention, in the speaker apparatus is the diaphragm comprises a tab section.

According to the present invention, the tab section is attached to the inside of the coil bobbin making it possible to securely attach the diaphragm to the coil bobbin.

(3) In another aspect of the present invention, in the speaker apparatus, the tab section is located on the inside of the coil bobbin.

According to the present invention, the tab section is attached to the inside of the coil bobbin making it possible to securely attach the diaphragm to the coil bobbin.

(4) In a further aspect of the present invention, the speaker apparatus is a coaxial speaker apparatus constructed such that position of the sound sources coincide with a plurality of frequency ranges.

According to the present invention, high-pitched sound from the high-pitch diaphragm inside the coil bobbin is output without being reflected by the inside of the edge section of the coil bobbin, so it possible to output sound having smooth frequency characteristics.

(5) In a further aspect of the present invention, in the speaker apparatus, the end section of the coil bobbin on the side of the diaphragm and the diaphragm are fastened together by attaching the tab section to the end section with adhesive.

According to the present invention, by attaching the tab section to the end section of the coil bobbin on the side of the diaphragm, it is possible to attach the diaphragm to the coil bobbin.

(6) The above object of the present invention can be achieved by a speaker apparatus provided with: a diaphragm and coil bobbin formed in cylindrical-shape, and not comprising a center cap that covers the end section of the coil bobbin; and where the diaphragm has a tab section, and the end section of the tab section is located such that it comes in contact with the end section of the coil bobbin on the side of the diaphragm, and where the coil bobbin and diaphragm are both located such that sound generated by the coil bobbin is not reflected.

According to the present invention, by constructing the speaker apparatus such that it comprises a cone-shaped diaphragm and a coil bobbin formed in cylindrical-shape, and does not comprise a center cap that covers the end section of the coil bobbin; and where the cone-shaped diaphragm has a tab section, and the end section of that tab section is located such that it comes in contact with the end section of the coil bobbin on the side of the cone-shaped diaphragm, and where the coil bobbin and cone-shaped diaphragm are both located such that sound generated by the coil bobbin is not reflected, the sound from the cone-shaped diaphragm is not reflected by other components such as the coil bobbin, so it is effective in making it possible to output sound having smooth frequency characteristics.

DESCRIPTION OF THE PREFERRED EMBODIMENTS

Next, the preferred embodiments of the present invention will be explained based on the drawings.

(1) First Embodiment

First, the construction and function of the speaker apparatus of this embodiment will be explained with reference to FIG. 2 to FIG. 5.

Figure 1:
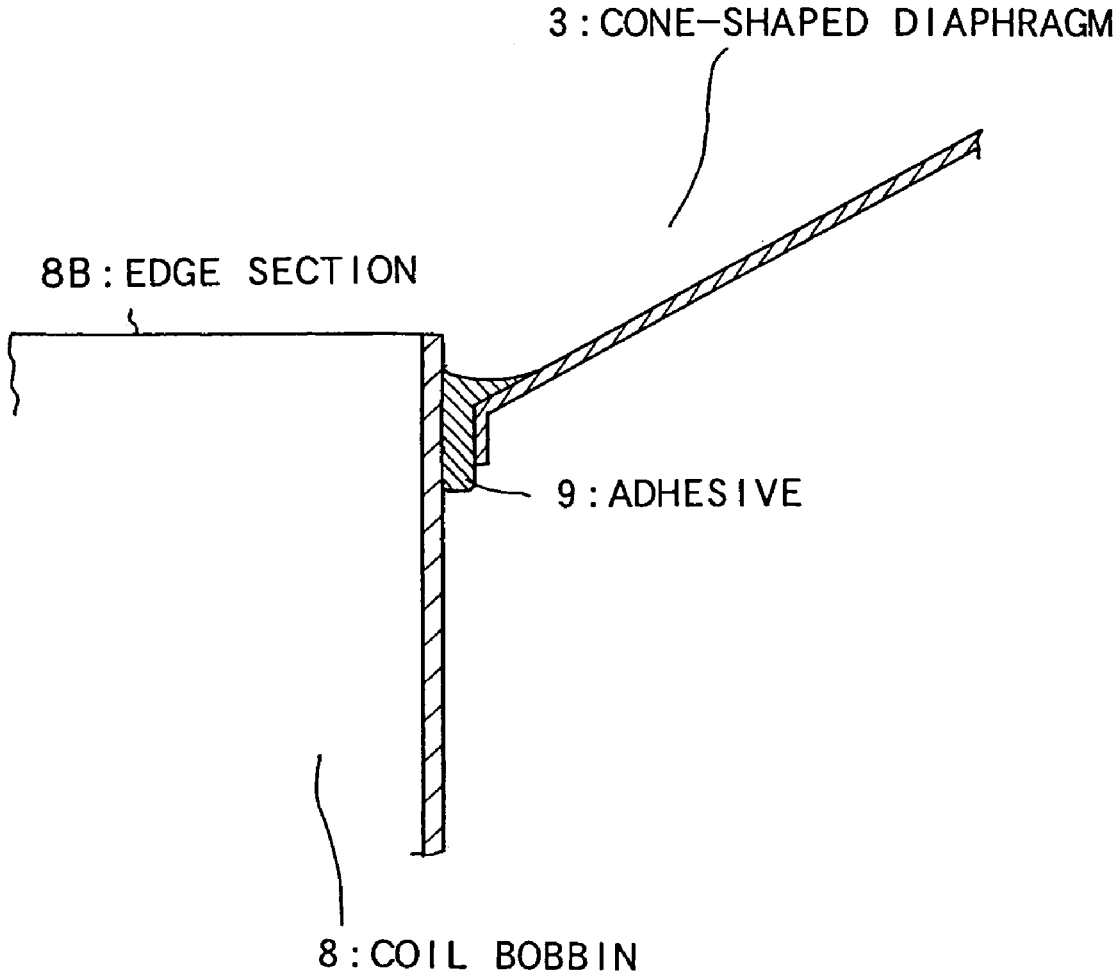
FIG. 1 is an enlarged view of a cross section of the main parts of the speaker apparatus according to the prior art.
Figure 2:
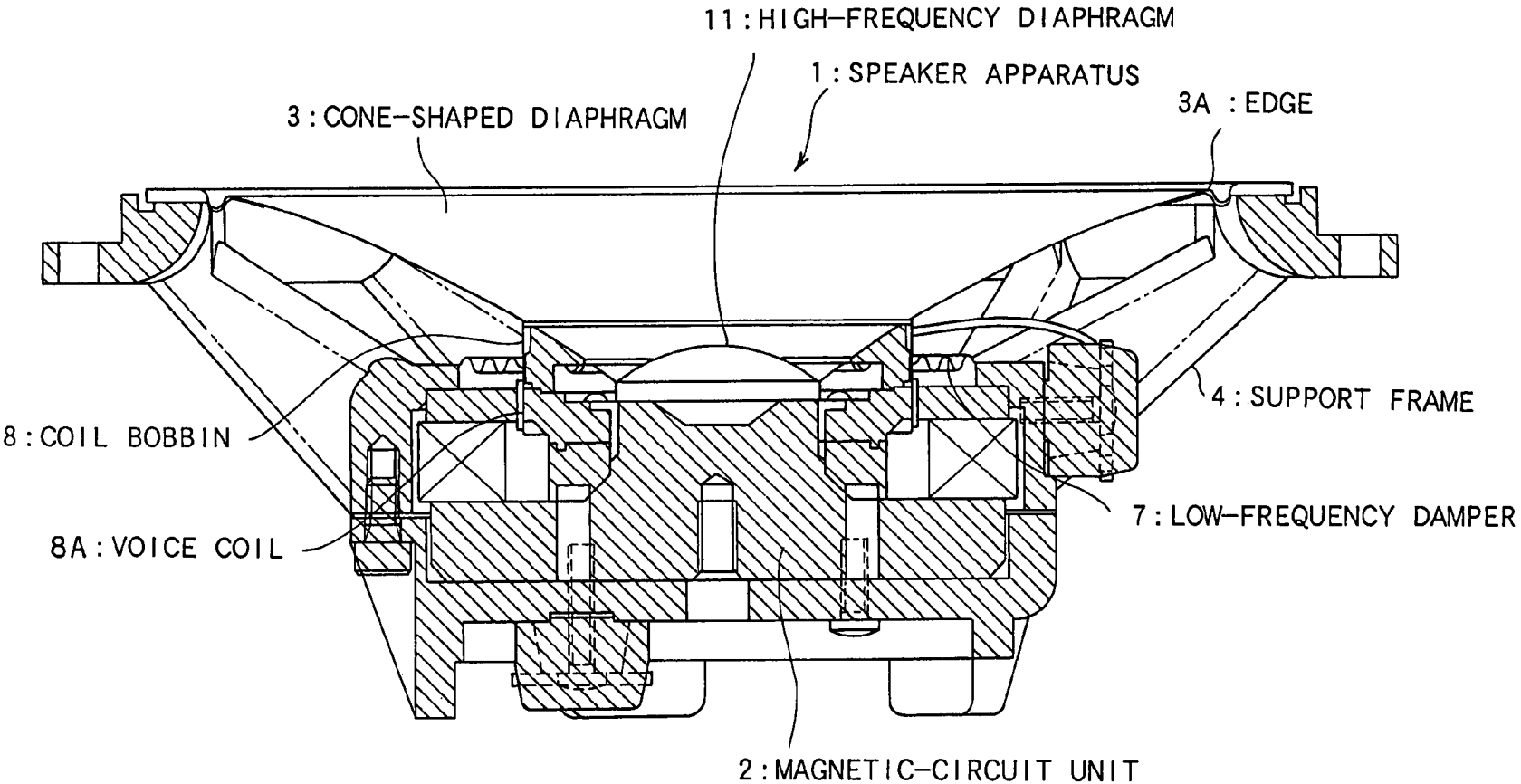
FIG. 2 is a side view of a cross section of the speaker apparatus of a first embodiment of the invention.
Figure 3:
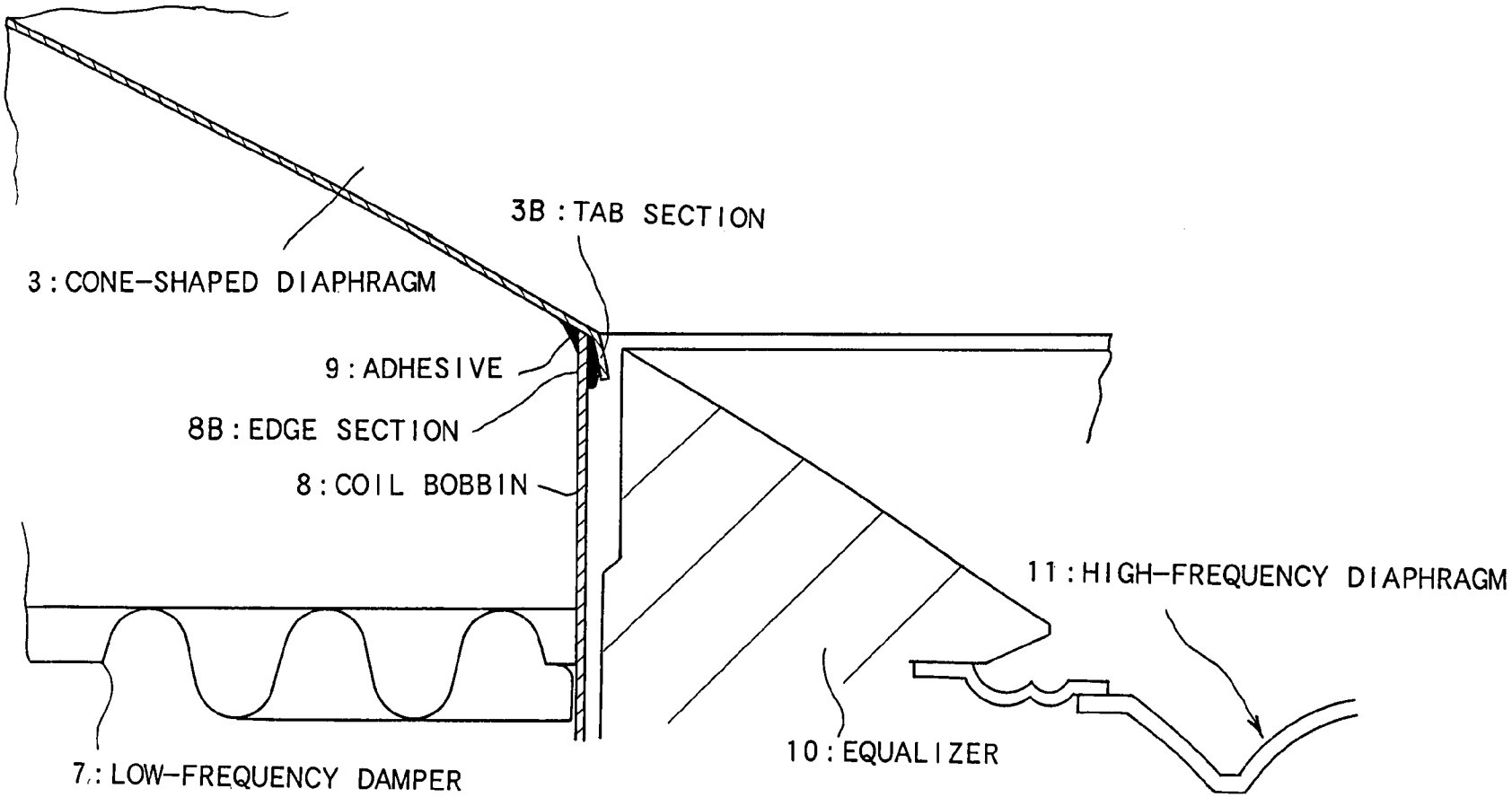
FIG. 3 is an enlarged view of a cross section of the main parts of the speaker apparatus of a first embodiment of the invention.

FIG. 2 is a side view of a cross section of the coaxial speaker apparatus of this first embodiment, and FIG. 3 is an enlarged view of the main parts of the speaker apparatus of this first embodiment.]

The speaker apparatus shown in FIG. 2 comprises: a magnetic-circuit unit 2, a cone-shaped diaphragm 3 that is formed into a cone shape as one example of the diaphragm, and a support frame 4 that supports the cone-shaped diaphragm 3 on magnetic-circuit unit 2.

The speaker apparatus of this embodiment is a coaxial-type speaker apparatus, and the cone-shaped diaphragm 3 is a diaphragm for low-pitch sounds.

On the inside of the magnetic-circuit unit 2 there is a coil bobbin 8 that is formed into a cylindrical shape around which the voice coil 8A is wound.

Also, near the inner edge of the cone-shaped diaphragm 3, there is a tab section 3B for attaching the coil bobbin 8 located at the base end of the speaker apparatus 1 to the cone-shaped diaphragm 3.

Also, the cone-shaped diaphragm 3 is constructed such that the outer edge 3A is supported by the support frame 4.

In the speaker apparatus 1 constructed as described above, a driving force is generated in the voice coil 8A by a signal current that is applied to the voice coil 8A, and this driving force vibrates the cone-shaped diaphragm 3 to generate sound.

There is a low-pitch damper 7 attached to the coil bobbin 8. This low-pitch damper 7 is formed such that it is wave shaped in the radial direction of the speaker apparatus 1.

Adhesive 9 is used to attach and fasten the cone-shaped diaphragm 3 to the coil bobbin 8.

As shown in the enlarged drawing of the cross section of the main parts in FIG. 3, there is an equalizer 10 inside the cylindrical-shaped coil bobbin 8 and it is adjacent to the inner wall of the coil bobbin 8. This equalizer 10 is formed into a conical shape that expands toward the side of the cone-shaped diaphragm 3, and there is a high-pitch diaphragm 11 inside the center of the equalizer 10.

Next, the construction of the cone-shaped diaphragm 3, coil bobbin 8 and equalizer 10 will be explained.

First, the equalizer 10 is formed in a conical shape that expands toward the side of the cone-shaped diaphragm 3. Here, in order that the sound generated from the high-pitch diaphragm 11 in the center of the equalizer 10, which is located inside the coil bobbin 8, is smoothly transmitted to the cone-shaped diaphragm 3, the equalizer 10 and the cone-shaped diaphragm 3 are located such that the inclined surface of the equalizer 10 is on the same plane as the inclined surface of the cone-shaped diaphragm 3.

Moreover, the cone-shaped diaphragm 3 described above is located such that it fits on the end section of the coil bobbin 8, and the tab section 3B of the cone-shaped diaphragm 3 is located on the inside of the edge section 8B of the coil bobbin 8 and is attached with adhesive 9.

As explained above, the speaker apparatus of this embodiment is constructed such that there is a tab section 3B on the cone-shaped diaphragm 3, and the cone-shaped diaphragm 3 is located such that it fits on the end section of the coil bobbin 8.

Figure 4:
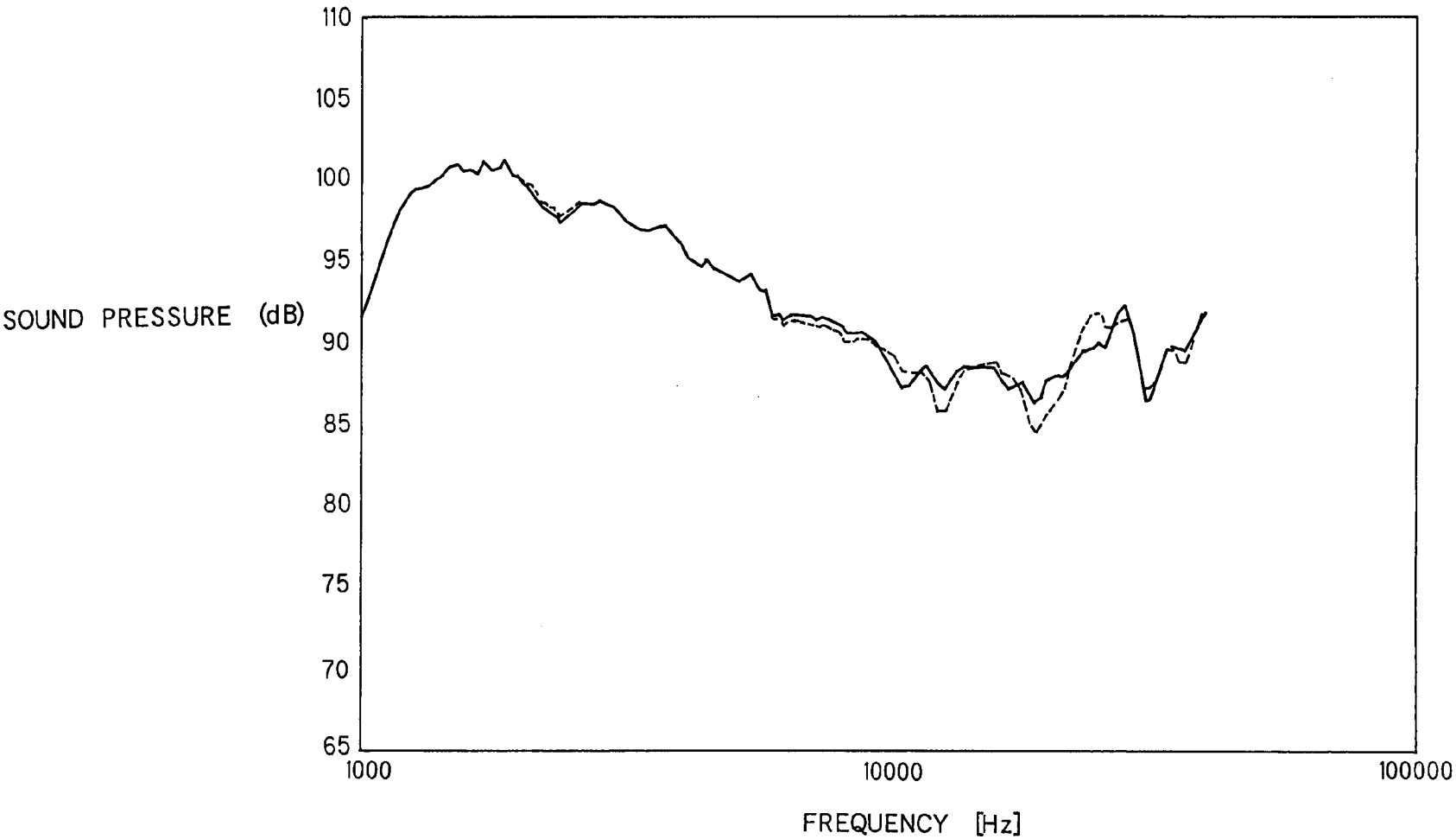
FIG. 4 is a drawing showing a comparison of the frequency characteristics of the speaker apparatus of a first embodiment of the invention and the speaker apparatus according to the prior art.

Next, as an example of a test to show the effect of the present invention, FIG. 4 shows a graph of the frequency characteristics of the speaker apparatus of this embodiment, and the frequency characteristics of the speaker apparatus according to the prior art.

In FIG. 4, the solid line shows the frequency characteristics of the speaker apparatus of this embodiment, and the dashed line shows the frequency characteristics of the speaker apparatus according to the prior art.

As can be clearly seen from FIG. 4, with the speaker apparatus of this embodiment, it is possible to obtain and output sound having smooth frequency characteristics.

Figure 5:
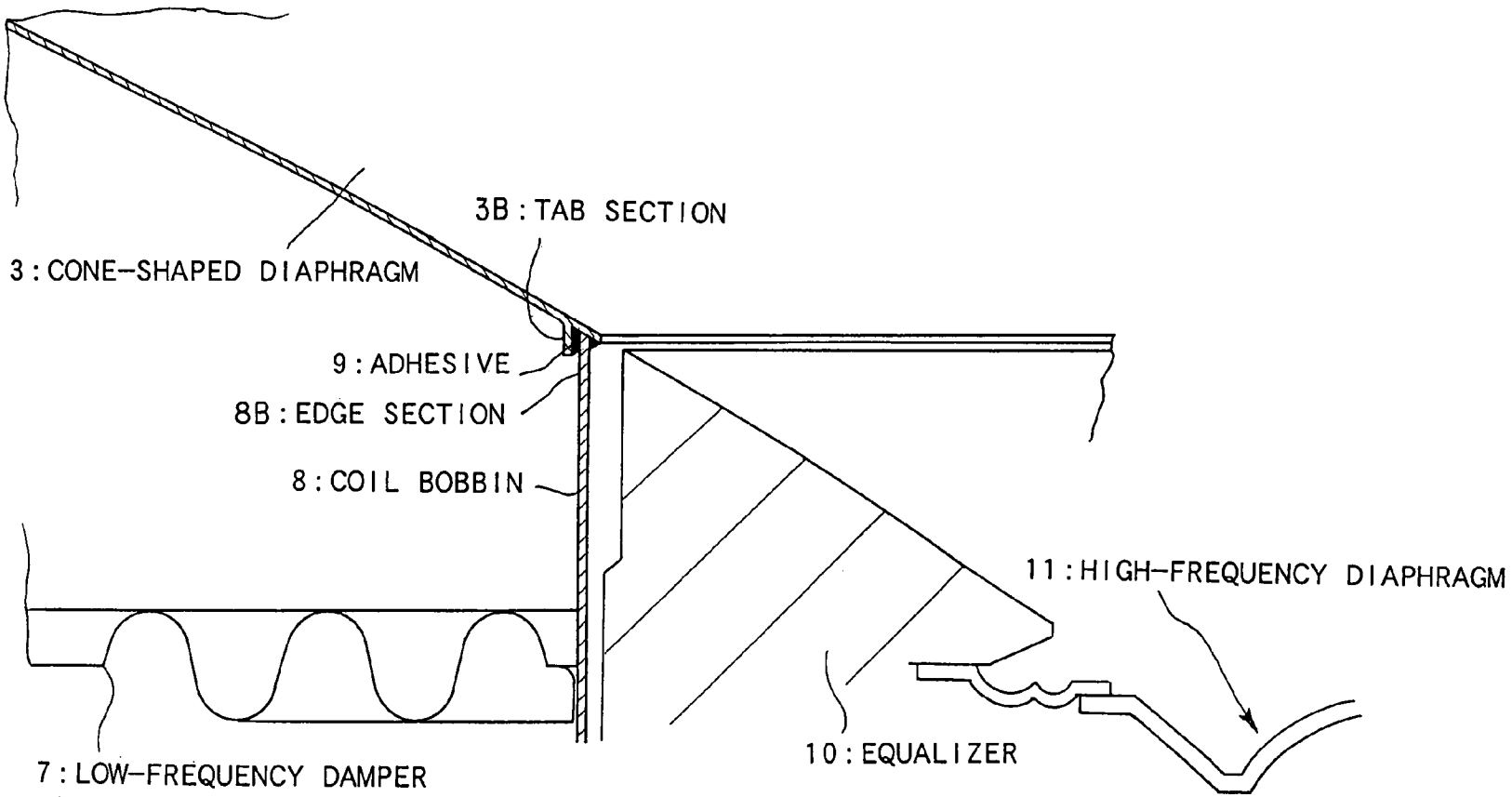
FIG. 5 is an enlarged view of the main parts of the speaker apparatus of a first embodiment of the invention.

In the explanation of the first embodiment above, the tab section 3B of the cone-shaped diaphragm 3 was located on the inside of the coil bobbin 8 and used for attaching the cone-shaped diaphragm 3 to the coil bobbin 8, however, it can be located anywhere on the cone-shaped diaphragm 3 or coil bobbin 8 as long as the high-pitched sound from the high-pitch diaphragm 11 located inside the coil bobbin 8 is not reflected by the inside of the edge section 8B of the coil bobbin 8. For example, as shown in FIG. 5, construction is possible in which the cone-shaped diaphragm 3 is located such that it rests on the end section of the coil bobbin 8, and the tab section 3B of the cone-shaped diaphragm 3 is located on the outside of the coil bobbin 8.

As explained above, with the speaker apparatus of this embodiment, high-pitched sound from the high-pitch diaphragm 11 located inside the coil bobbin 8 is output without being reflected by the inside of the edge section 8B of the coil bobbin 8, so it is possible to output sound having smooth frequency characteristics.

(2) Second Embodiment

Figure 6:
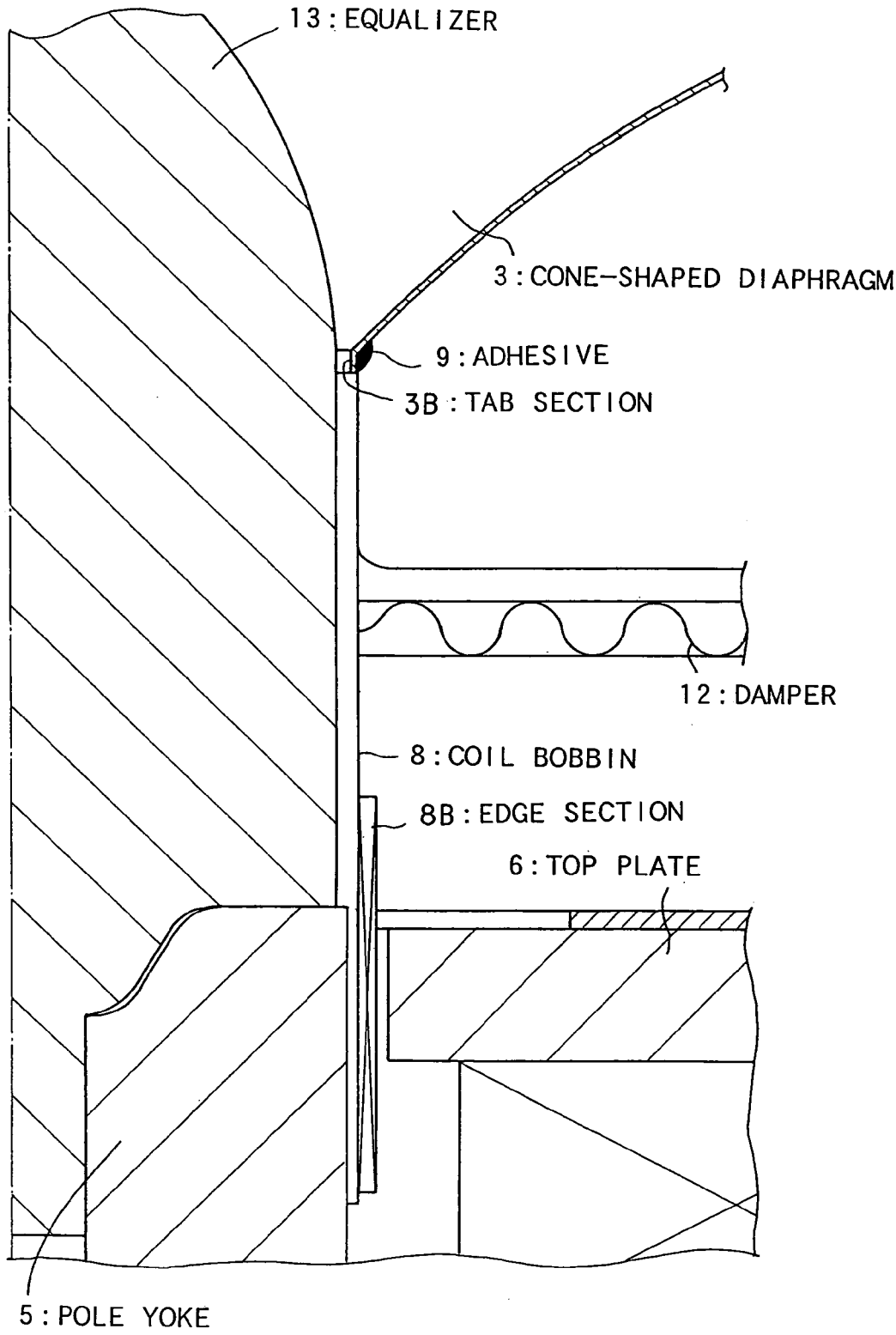
FIG. 6 is an enlarge view of the main parts of the speaker apparatus of a second embodiment of the invention.

Next, a second embodiment of the invention will be explained using FIG. 6.

In the first embodiment, a preferred embodiment in which the invention was applied to a coaxial speaker was explained, however, in the second embodiment, a preferred embodiment in which the invention is applied to a speaker other than a coaxial speaker will be explained.

In the first embodiment, by locating the cone-shaped diaphragm such that it rested on the end section of the coil bobbin, the frequency characteristics of high-pitched sound output from a high-pitch diaphragm located inside the coil bobbin was improved, however, in this second embodiment, a tab section located on the cone-shaped diaphragm is located such that it rests on and is attached to the end section of the coil bobbin.

The magnetic-circuit unit of this embodiment comprises: a pole yoke 5 located in the center section, a ring-shaped top plate 6 that is located such that is goes around the pole yoke 5, and a cylindrical-shaped coil bobbin 6 around which a bobbin coil 8A is wound.

Also, similar to the first embodiment, there is a tab section 3B near the inner edge of the cone-shaped diaphragm 3 for attaching the coil bobbin 8, which is located at the base end of the speaker apparatus, to the cone-shaped diaphragm 3.

There is a damper 12 attached to the coil bobbin 8. This damper 12 is formed such that it is wave shaped in the radial direction of the speaker apparatus.

Moreover, adhesive 9 is used to attach and fasten the cone-shaped diaphragm 3 to the coil bobbin 8.

Also, there is an equalizer 13 inside the cylindrical-shaped coil bobbin 8. This equalizer 13 is inside the coil bobbin 8 and is formed such that it has a convex shaped in the direction toward the cone-shaped diaphragm 13.

Next, the construction of the cone-shaped diaphragm 3 and coil bobbin 8 will be explained.

The tab section 3B of the cone-shaped diaphragm 3 described above is attached with adhesive 9 such that it rests on the end section of the coil bobbin 8. Here, the end surface of the tab section 3B is attached such that it faces the end surface of the coil bobbin 8.

The speaker apparatus of this second embodiment explained above is constructed such that there is a tab section 3B on the cone-shaped diaphragm 3 described above, and that tab section 3B rests on the end section of the coil bobbin 8 and positions the cone-shaped diaphragm 3 and coil bobbin 8.

In this way, the sound from the cone-shaped diaphragm 3 is not reflected by other components such as the coil bobbin 8, for example, and it is possible to output sound having smooth frequency characteristics.

This invention is not limited to the construction of the speaker apparatus explained in the first and second embodiments, and the invention can be applied to any speaker apparatus that does not have a center cap that covers the end section of the coil bobbin.

As explained above, this invention is a speaker apparatus that comprises a cone-shaped diaphragm and cylindrical-shaped coil bobbin, however, does not comprise a center cap that covers the end section of the coil bobbin, and where the cone-shaped diaphragm is located such that it rests on the end section of the coil bobbin; and by constructing the coil bobbin and diaphragm such that they are located in a way where sound generated by the coil bobbin is not reflected, the invention is constructed such that sound from inside the coil bobbin is not reflected by the inside of the edge section of the coil bobbin, and thus it is effective in making it possible to output sound having smooth frequency characteristics.

Also, in other construction, this invention is a speaker apparatus that comprises a cone-shaped diaphragm and cylindrical-shaped coil bobbin, however, does not comprise a center cap that covers the end section of the coil bobbin, and the cone-shaped diaphragm has a tab section, and the end section of that tab section is located such that it comes in contact with the end section of the coil bobbin on the side of the cone-shaped diaphragm; and by constructing the coil bobbin and diaphragm such that they are located in a way where sound generated by the coil bobbin is not reflected, sound from the cone-shaped diaphragm is not reflected by other components such as the coil bobbin, and the invention is effective in making it possible to output sound having smooth frequency characteristics.

The entire disclosure of Japanese Patent Application No.2003-185125 filed on Jun. 27, 2003 including the specification, claims, drawings and summary is incorporated herein by reference in its entirety.

What is claimed is:

1. A speaker apparatus comprising a diaphragm and a cylindrical-shaped coil bobbin, and not comprising a center cap that covers said coil bobbin, and wherein said diaphragm is located such that it rests on the end section of said coil bobbin;

said coil bobbin and said diaphragm are located such that sound from said coil bobbin is not reflected; and said diaphragm comprises a tab section, and said tab section is located inside said coil bobbin.

2. The speaker apparatus according to claim 1 wherein said speaker apparatus is a coaxial speaker apparatus constructed such that the locations of the sound sources coincide with a plurality of frequency ranges.

3. The speaker apparatus according to claim 1 wherein the end section of said coil bobbin on the side of said diaphragm and said diaphragm are fastened by attaching said tab section to said end section with adhesive.

4. A speaker apparatus comprising a diaphragm and a cylindrical-shaped coil bobbin, and not comprising a center cap that covers said coil bobbin, and wherein said diaphragm comprises a tab section, wherein said tab section is located such that it rests on the end section of said coil bobbin;

said coil bobbin and said diaphragm are located such that sound from said coil bobbin is not reflected; and said tab section is located inside said coil bobbin.

* * * * *